US005984618A

United States Patent [19]

Deneve et al.

[11] Patent Number: 5,984,618

[45] **Date of Patent: *Nov. 16, 1999**

[54] BOX BOOM LOADER MECHANISM

[75] Inventors: Jeffrey A. Deneve; Owen S. Loughrin; Charles T. McMillan, all of Sanford, N.C.

[73] Assignee: Caterpillar Inc., Peoria, Ill.

[ * ] Notice: This patent is subject to a terminal disclaimer.

[21] Appl. No.: 09/047,174

[22] Filed: Mar. 24, 1998

Related U.S. Application Data

[60] Provisional application No. 60/051,315, Jun. 30, 1997.

[51] Int. Cl.[6] ..... B66C 23/00

[52] U.S. Cl. ..... 414/722; 414/697; 414/706

[58] Field of Search ..... 414/722, 700–715, 414/697; 212/347; 52/111, 116, 632, 731.2, 731.6, 732.1, 735.1; 29/897.2, 897.31; 228/165, 166, 667, 174, 182

[56] References Cited

U.S. PATENT DOCUMENTS

| | | | |
|---|---|---|---|
| D. 323,168 | 1/1992 | Ericsson | D15/32 |
| 3,648,871 | 3/1972 | Layton . | |
| 3,794,195 | 2/1974 | Clevenger et al. . | |
| 3,890,696 | 6/1975 | Buske | 228/173 |
| 3,902,295 | 9/1975 | Yancey | 52/730 |
| 4,069,637 | 1/1978 | Braithwaite | 52/726 |
| 4,153,167 | 5/1979 | Gill . | |
| 4,163,498 | 8/1979 | Grooss et al. | 414/697 |
| 4,239,444 | 12/1980 | Schmelzer | 414/685 |
| 4,275,542 | 6/1981 | Moro et al. | 52/731 |
| 4,392,314 | 7/1983 | Albrecht et al. | 37/103 |
| 4,428,173 | 1/1984 | Knell | 414/722 |
| 4,480,955 | 11/1984 | Andrews et al. | 414/723 |
| 4,643,631 | 2/1987 | Maurer et al. | 414/723 |

(List continued on next page.)

FOREIGN PATENT DOCUMENTS

| | | | |
|---|---|---|---|
| 962233 | 2/1975 | Canada . | |
| 438-931 | 7/1991 | European Pat. Off. | E02F 3/40 |
| 2418-840 | 9/1979 | France | 37/403 |
| 1456538 | 1/1969 | Germany . | |
| 4211078 | 10/1993 | Germany | E02F 3/43 |
| 3-180628 | 8/1991 | Japan . | |
| 2087349 | 5/1982 | United Kingdom | E02F 3/81 |
| 2195610 | 4/1988 | United Kingdom | E02F 3/80 |
| 82/02731 | 8/1982 | WIPO | E02F 3/96 |
| 83/03629 | 10/1983 | WIPO | E02F 3/96 |
| 90/06403 | 6/1990 | WIPO | E02F 3/38 |

OTHER PUBLICATIONS

Patent Application—Serial No. 08/680,341—"Hitch Assembly for the Front Frame of an Articulated Construction Machine" —Filed Jul. 12, 1996.

Patent Application Serial No. 08/679,546—"Frame Assembly for an Articulated Construction Machine" —Filed Jul. 12, 1996.

Patent Application Serial No. 08/682,829 " Frame Assembly for a Construction Machine" Filed Jul. 12, 1996.

Rylind—Wedge Lock Coupler Systems one page.

Verachtert—Schnellwechsel–einrichtung System 2000 Publication—5 pages.

*Primary Examiner*—Donald W. Underwood
*Attorney, Agent, or Firm*—Diana L. Charlton

[57] ABSTRACT

The present invention includes a box boom loader mechanism utilizing a box boom lift arm assembly with a single plate steel top wall and a bottom wall connected with a non-transverse weld to a pair of single plate steel inner side walls to define a rectangular cross section therealong. The connection of the top and bottom walls and the inner side walls defines a bifurcated second end portion straddling a central portion of a frame and being connected therewith. A tilt linkage means is connected to the box boom lift arm assembly and includes a tilt lever, tilt link and tilt cylinder. The connection of the components of the tilt linkage means achieves high visibility and optimal linkage performance. The connection of the bifurcated second end portion to the frame and the non-transverse weld improves strength and fatigue characteristics of the box boom loader mechanism without increasing the weight of the machine.

13 Claims, 11 Drawing Sheets

U.S. PATENT DOCUMENTS

| | | | |
|---|---|---|---|
| 4,768,917 | 9/1988 | Garman | 414/697 |
| 4,776,750 | 10/1988 | Griswold et al. | 414/698 |
| 4,944,628 | 7/1990 | Hulden | 403/24 |
| 4,963,071 | 10/1990 | Larwin et al. | 414/723 |
| 5,111,578 | 5/1992 | Ball et al. | 29/891 |
| 5,125,787 | 6/1992 | Ball et al. | 414/722 |
| 5,152,659 | 10/1992 | Waka | 414/722 |
| 5,156,520 | 10/1992 | Ericson et al. | 414/700 |
| 5,400,531 | 3/1995 | Brown | 37/468 |
| 5,568,841 | 10/1996 | Weissbach | 180/311 |
| 5,595,471 | 1/1997 | Ajilore | 414/685 |
| 5,599,158 | 2/1997 | Ajilore | 414/685 |
| 5,611,656 | 3/1997 | Davis et al. | 414/694 |

318
326
386
382
410
414
430
244
236
434
240
232
310
84
96
266
250
262
88
302
338
296
294
322
254
270
521
496
496
398
532
528
524
228
532
528
26

318
450
326
322
18
410
84
277
294
26

BOX BOOM LOADER MECHANISM

CROSS REFERENCE TO RELATED APPLICATIONS

This application is based, in part, on the material disclosed in U.S. provisional patent application Ser. No. 60/051315 filed Jun. 30, 1997.

TECHNICAL FIELD

This invention relates generally to a box boom loader mechanism for a wheel loader having a rectangularly sectioned box boom lift arm and more particularly to the connection of the box boom lift arm to a frame of the wheel loader and to a tilt linkage assembly.

BACKGROUND ART

Present construction machines, such as wheel loaders, typically include a slab lift arm which is mounted to a frame of the machine by various connection means. Box boom lift arms may be used in place of the slab lift arms on some wheel loaders to gain higher strength capabilities. Some of these box boom lift arms have a hollow unitary structure made from two or more castings connected by a transversely welded midsection. The box boom lift arm is generally connected to various components, such as a frame or tilt linkage assembly, with configurations that increase strength capabilities, visibility and effectiveness of the machine.

During operation of the wheel loader; the box boom lift arm and tilt linkage assembly are subjected to a high degree of loading, some of which may be severe. Therefore, it is critical that each component has sufficient configuration and connection to one another to provide the strength necessary to withstand these loads and forces while limiting the weight so as to not affect overall machine performance. The strength requirements for each of the components of the box boom loader mechanism are coupled with the need to increase visibility for an operator of the machine during operation.

One such design is disclosed in U.S. Pat. No. 4,768,917 issued to Anthony L. Garman on Sep. 6, 1988. In this design, the boom arm is made from two hollow end castings welded together by a welded midsection. The connection of the boom arm to the frame utilizes a pivotal pin joint mounted across the outer walls of the frame. The mounting of the boom arm in such a manner requires that the majority of loading takes place at the pin joint and at the transverse welded midsection of the boom arm which may increase the risk of failure of the welded castings. The tilting arrangement in Garman utilizes a tilt lever that is an elongate member having three distinct areas of connection that withstand the majority of the loads and forces on the machine during operation of the linkage The mass of the tilt lever must be increased in order to withstand the loads and forces incurred which may limit overall performance of the machine. Additionally, visibility of the machine is hampered by the connection of the tilt cylinder at the distal end of the tilt lever.

The present invention is directed to overcoming the problems as set forth above.

DISCLOSURE OF THE INVENTION

In one aspect of the present invention, a box boom loader mechanism is disclosed for use on a construction machine. The construction machine has a frame with a pair of outer side wall portions, a central portion with a pair of inner side wall portions disposed between the outer side wall portions and spaced a predetermined distance therefrom. The box boom loader mechanism includes a box boom lift arm assembly which has a pair of inner side walls extending a predetermined length, top and bottom walls which extend a predetermined length substantially equal to the predetermined length of the pair of inner side walls and is fixedly connected therewith to define a first end portion and a pair of outer side walls is connected at a predetermined location along the predetermined length of the pair of inner side walls and extends outwardly therefrom a predetermined length with each outer side wall being fixedly connected to the top and bottom walls to define a bifurcated second end portion opposite the first end portion. The bifurcated second end portion straddles the central portion of the frame and terminates in pivotal connection with the frame at a frame pin joint. A tilt linkage means is pivotally connected to the box boom lift arm assembly. A lower pin boss is fixedly connected to the box boom lift arm assembly at the first end portion and an upper pin boss is fixedly connected to the tilt linkage means A first hydraulic cylinder is pivotally connected to the frame at a first end and is pivotally connected to the tilt linkage means at a second end. A second hydraulic cylinder is pivotally connected to the frame at a first end and is pivotally connected at a second end to the box boom lift arm assembly at a first pin joint adjacent the bottom wall.

The present invention includes a box boom loader mechanism utilizing a box boom lift arm assembly with top and bottom walls fixedly connected to a pair of inner side walls substantially along a predetermined length of the inner side walls to define a bifurcated end portion straddling and connected through a central portion of a frame of a construction machine. The connection of the bifurcated end portion to the frame and the unique connection of the top and bottom walls to the pair of inner and outer side walls increases the load capacity and strength of the box boom loader mechanism without increasing the weight of the machine.

BEST MODE FOR CARRYING OUT THE INVENTION

Figure 1:
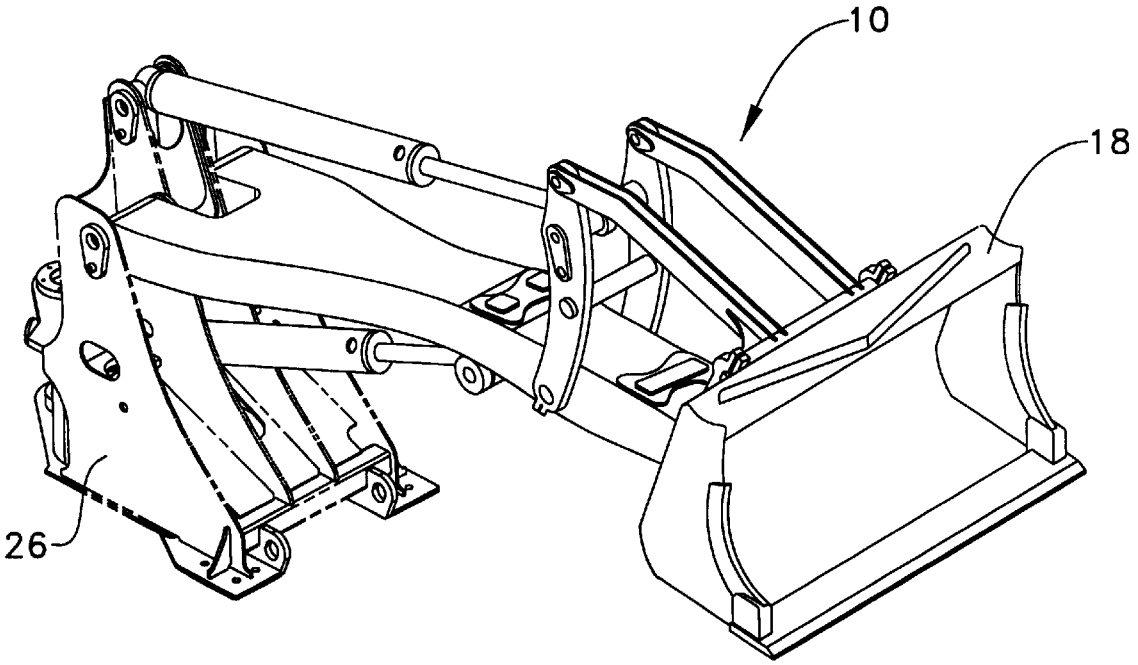
FIG. 1 is a partial isometric view of a construction machine embodying a box boom loader mechanism of the present invention.

While the invention is susceptible to various modifications and alternative forms, a specific embodiment thereof has been shown by way of example in the drawings and will herein be described in detail. It should be understood, however, that there is no intent to limit the invention to the particular form disclosed, but on the contrary, the intention is to cover all modifications, equivalents, and alternatives falling within the spirit and scope of the invention as defined by the appended claims.

Referring to the drawings, it can be seen that a box boom loader mechanism 10 for use on a construction machine 14, such as a wheel loader, is disclosed which connects a work implement 18 to an engine main frame 22 of the construction machine 14. It should be understood that although the wheel loader shown is articulated, a non-articulated machine or any type of construction machine might be used in conjunction with the present invention. It should also be understood that although the work implement shown in FIG. 1 is a bucket commonly used in conjunction with a wheel loader that any one of a number of different tools may be used.

Figure 2:
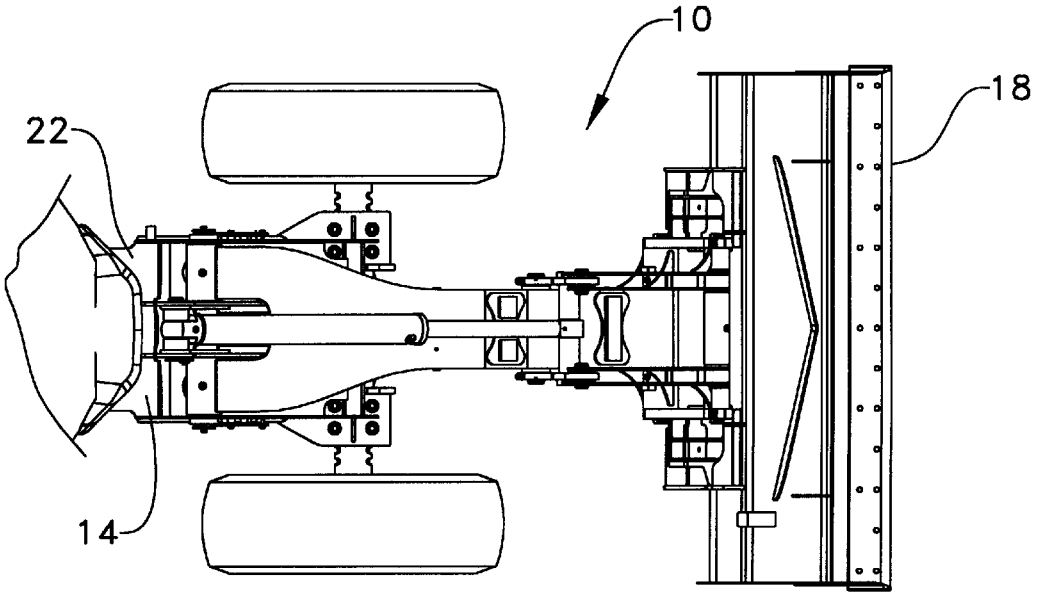
FIG. 2 is a partial top view of a construction machine embodying the box boom loader mechanism of the present invention.
Figure 3:
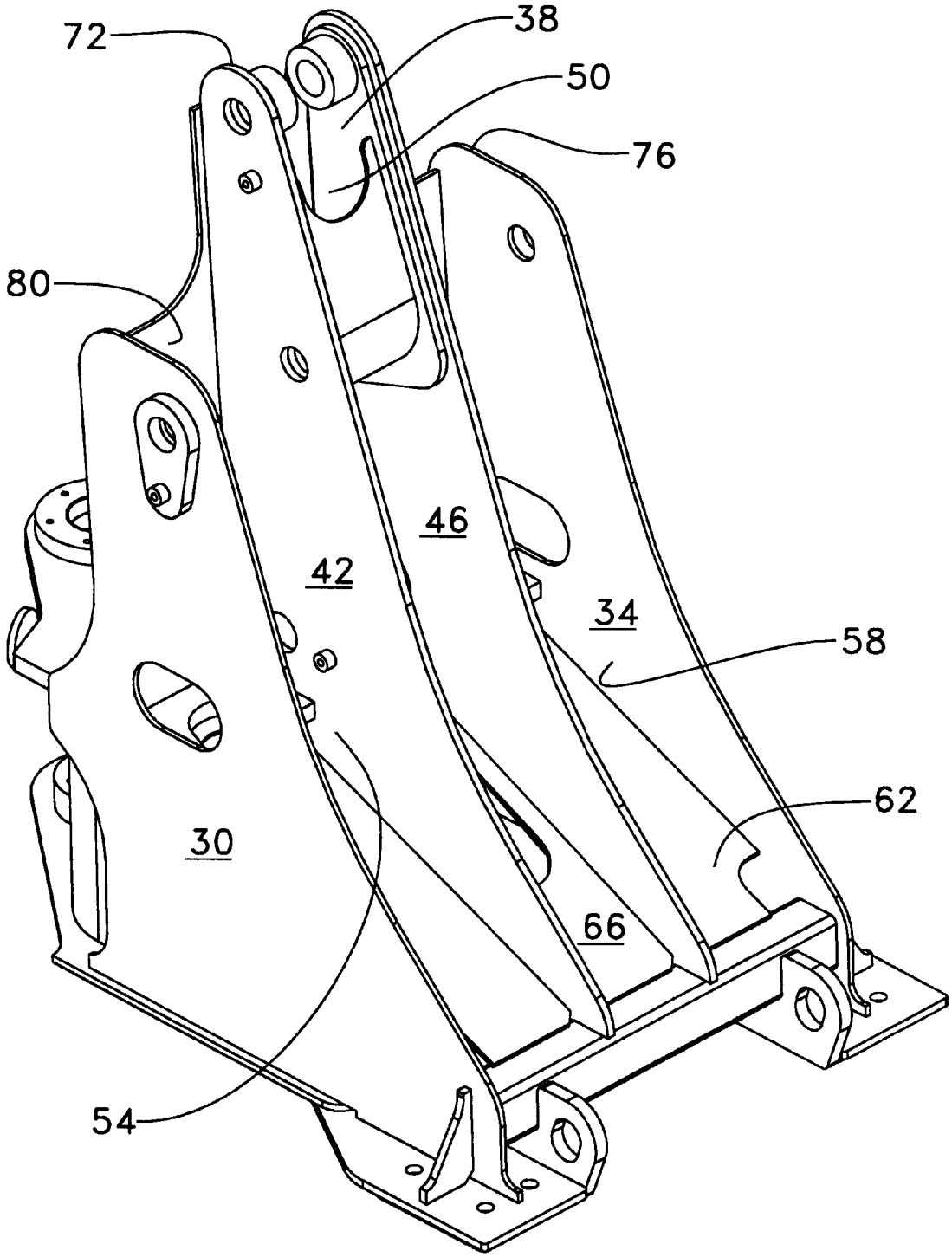
FIG. 3 is an isometric view of a non-engine end frame of the construction machine to which the present invention is mounted.

A non-engine end frame 26 is connected to the engine main frame 22 of the construction machine 14 in a well known manner. The non-engine end frame 26, shown more clearly in FIGS. 1–3, includes a pair of outer side wall portions 30,34 and a central tower portion 38 with a pair of inner side wall portions 42,46 positioned to define an interior space 50 therebetween. Each of the inner side wall portions 42,46 has a predetermined length which is greater than a predetermined length of the outer side wall portions 30,34 and are spaced from the outer side wall portions 30,34 to define a pair of exterior spaces 54,58. The outer side wall portions 30,34 are connected integrally at a bottom plate 62 with a bottom plate 66 and surrounding structure of the central tower portion 38. An upper surface 72 of the central tower portion 38 extends above an upper surface 76 of the outer side wall portions 30,34 and is connected therewith through a back wall portion 80.

The box boom loader mechanism 10 has a six-bar linkage which includes a box boom lift arm assembly 84 that is directly positioned between the non-engine end frame 26 and the work implement 18 as can be seen more clearly in FIGS. 4–10. The box boom lift arm assembly 84 is substantially positioned on a vertical plane that is coincident with a centerline defined by the construction machine 14. The box boom lift arm assembly 84 has a pair of spaced inner side walls 88,92 which extend a specified length approximately 0.9 to 1.1 times the length of the machine wheelbase. Each inner side wall 88,92 is constructed from a single sheet of plate steel or any other suitable type of material. A top wall 96 is formed along its length at a location approximately 0.4 to 0.6 times the total length of the box boom lift arm 84 therealong and is an angled five to fifteen degrees to achieve a length approximately equal to the length of the spaced inner side walls 88,92. The top wall 96 includes a central portion 100 with a width of approximately fifteen to twenty-five percent the machine tread width. A first end portion 104 diverges outwardly from the central portion 100 at a width approximately 1.8 to 2.2 times the width of the central portion 100. A bifurcated second end portion 108 opposite the first end portion 104 diverges outwardly from the central portion 100 in a substantial U-shape at a width approximately 2.0 to 2.3 times the width of the central portion 100. The top wall 96 is constructed from a single piece of plate steel or from any other suitable type of material. The top wall 96 is fixedly connected at a top surface 116 defined by the pair of spaced inner side walls 88,92 through a continuous non-transverse weld substantially along the entire predetermined length of the spaced inner side walls 88,92. A bottom wall 120 consists of a first plate member 124 fixedly connected to a bifurcated second plate member 128 through a transverse weld therebetween. The first plate member 124 is formed at a location approximately halfway along its total length and angled at approximately five to fifteen degrees to achieve in combination with the second plate member 128 a length approximately equal to the length of the spaced inner side walls 88,92. The first and second plate members 124, 128 are fixedly connected at a bottom surface 130 defined by the pair of spaced inner side walls 88,92 through a continuous non-transverse weld substantially along the entire predetermined length of the spaced inner side walls 88,92. The first plate member 124 and the bifurcated second plate member 128 define a central portion 132, a first end portion 136 and a bifurcated second end portion 140 of the bottom wall 120 with widths corresponding to the respective central portion 100, first end portion 104 and bifurcated second end portion 108 of the top wall 96 and positioned in a spaced relation therewith. The connection of the first end portions 104,136 of the top wall 96 and first plate member 124 of the bottom wall 120 with each of the pair of inner side walls 88,92, respectively, define a coupler end portion 144. A pair of outer side walls 148,152 are constructed from a single piece of plate steel or any other suitable material and each have a length of approximately 0.2 to 0.4 times the length of the box boom lift arm 84. Each of the pair of outer side walls 148,152 include first and second ends 156,160,164,168, respectively. Each of the pair of outer side walls 148,152 are disposed between an outer portion 172 of the bifurcated second end portions 108,140 of the top and bottom walls 96,120, respectively, and are welded at the first ends 156,164 to a respective one of the pair of inner side walls 88,92. The pair of outer side walls 148,152 are fixedly connected to the outer portion 172 of the top and bottom walls 96,120 through a continuous non-transverse weld extending substantially along the length of the outer side walls 148,152. The pair of outer side walls 148,152 combine to conform to the U-shape of the bifurcated second end portions 108,140 of the top and bottom walls 96,120, respectively. The second ends 160,168 of the pair of outer side walls 148,152 terminate in a substantial co-planar relationship with the bifurcated second ends 108,140 of the top and bottom walls 96,120, respectively, and each of the inner side walls 88,92, respectively, to define a bifurcated end portion 176 with a pair of legs 180,184 opposite the coupler end portion 144. Each of the pair of legs 180,184 of the bifurcated end portion 176 have a width of approximately 0.5 to 0.75 times the width of the central portion 100. A closure plate 186 is positioned between the inner side walls 88,92 and pair of legs 180,184 and has a predetermined length and width substantially equal to the distance between the spaced inner side walls 88,92 and between the spaced top and bottom walls 96,120, respectively. The closure plate 186 is circumferentially welded along the inner side walls 88,92 and between the bifurcated end portion 176 to substantially enclose the box boom lift arm assembly 84.

It should be understood that although the top wall, inner side walls and outer side walls of the box boom lift arm assembly are constructed from a single piece of plate steel welded substantially with non-transverse welds for maximum performance, the parts could be made in any of a number of ways, such as casting or welding part or all of the entire box boom lift arm assembly.

Second ends 192,200 of the pair of inner side walls 88,92, respectively, and the second end 160,168 of the pair of outer side wall 148,152 have an inwardly extending semi-circular shape which define together a pair of contoured frame boss mounting surfaces 204,208 at a distal portion 212 of the legs 180,184. First ends 188,196 of the pair of inner side walls 88,92, respectively, have an inwardly extending semi-circular shape which define a contoured coupler boss mounting surface 216.

Figure 8:
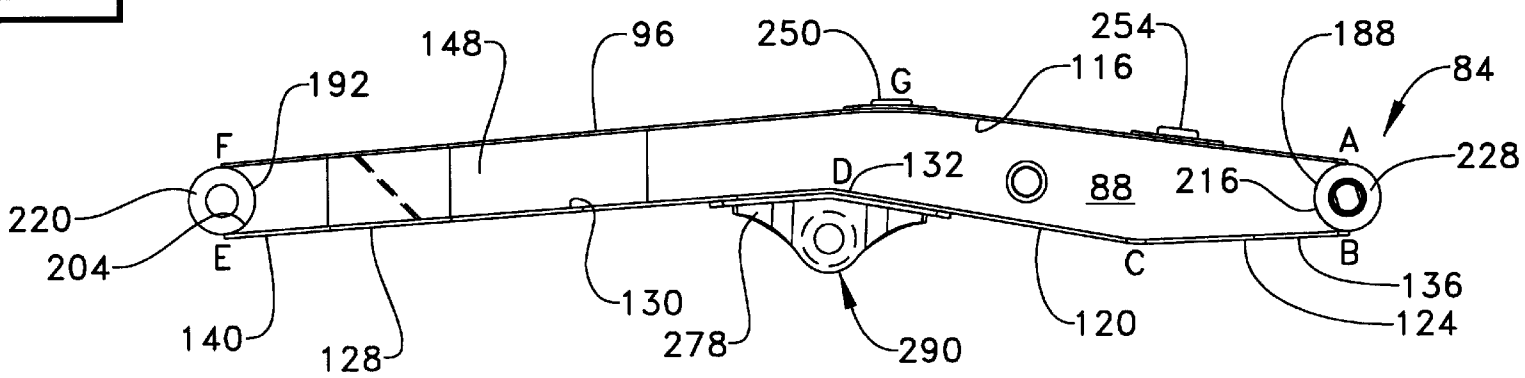
Figure 9:
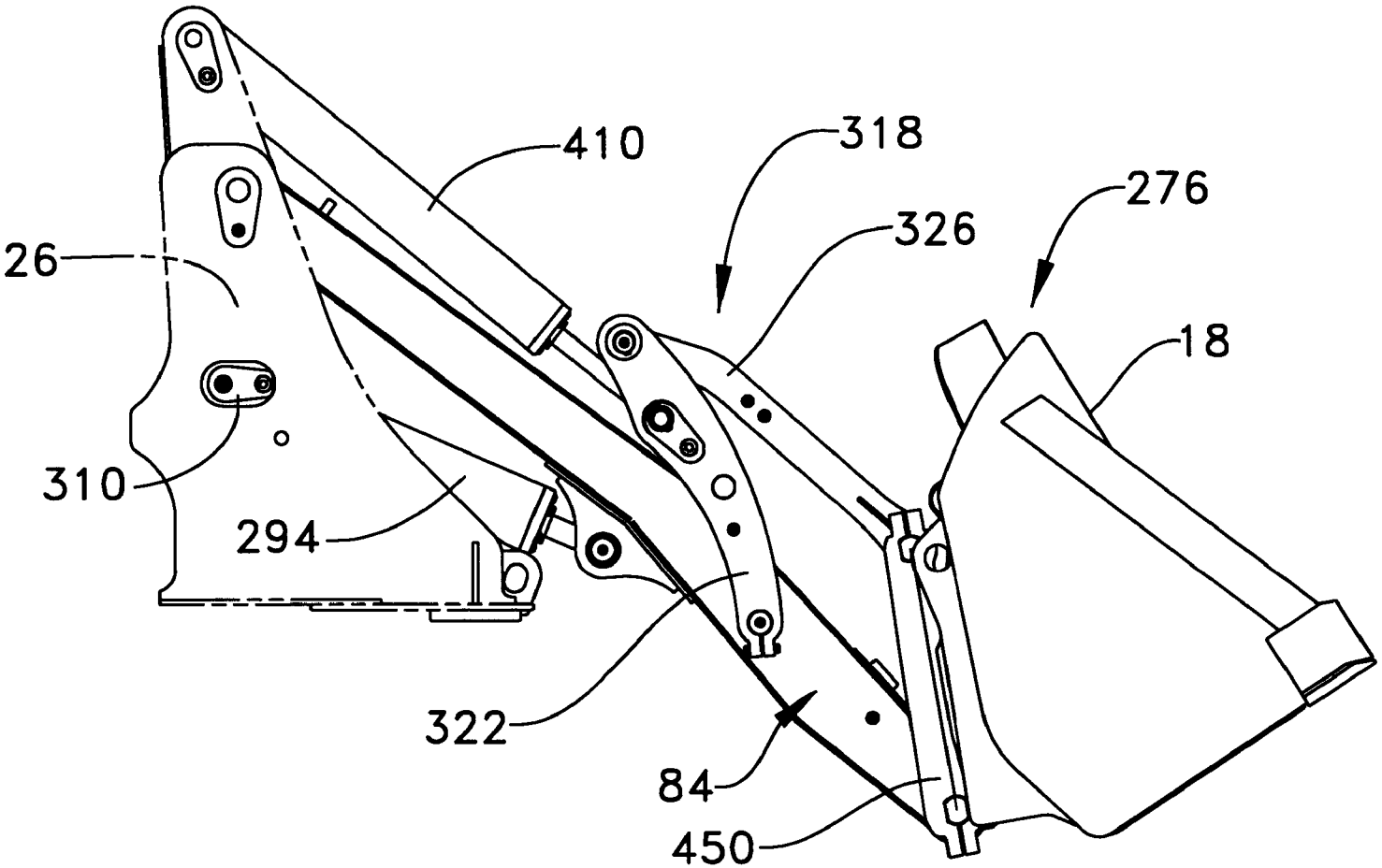
FIG. 9-10 are side views demonstrating a portion of the lift operation range of the box boom loader mechanism.
Figure 10:
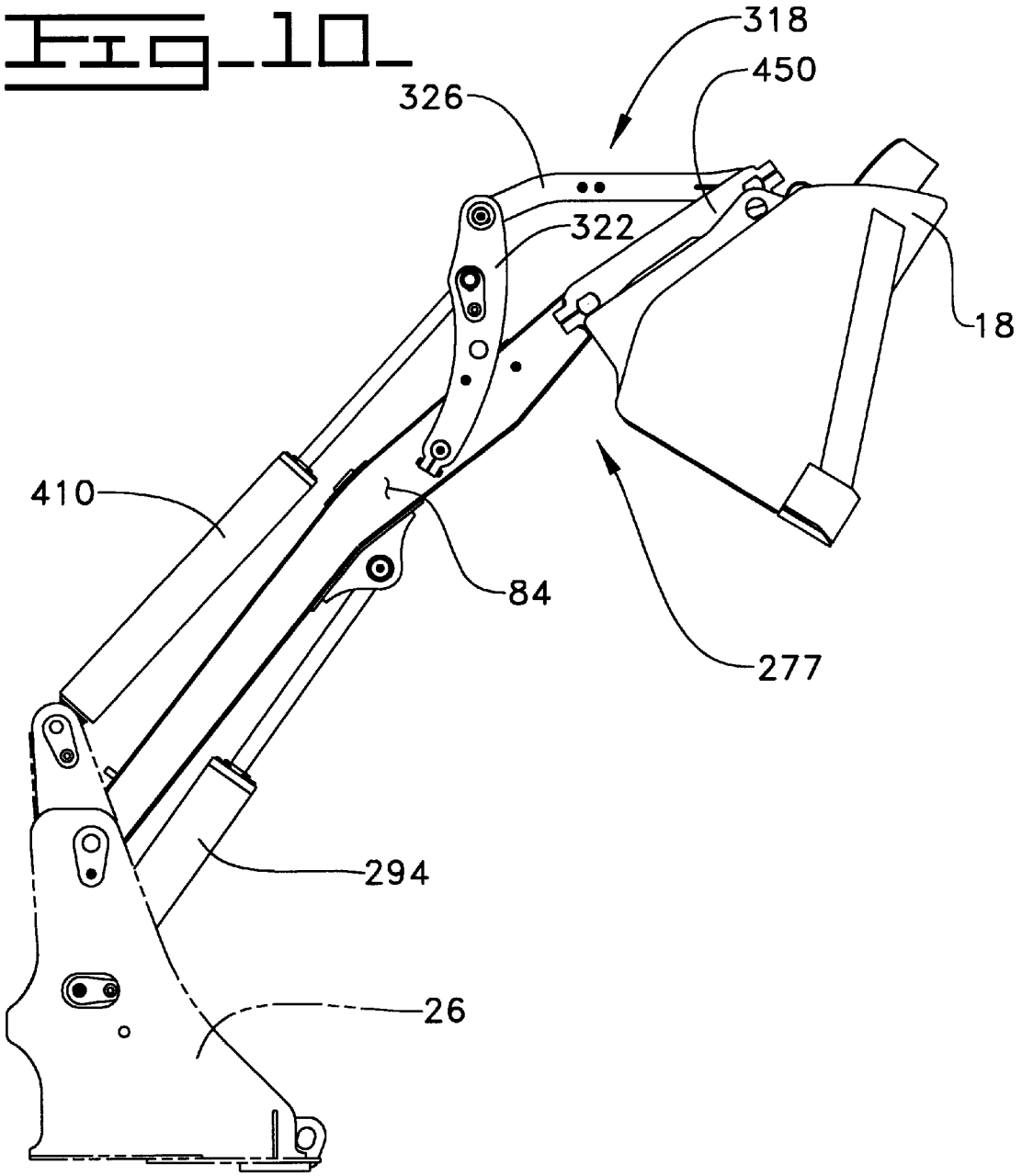

Each inner side wall 88,92 has a transitional width thereacross consisting of several point locations along the length. Referring more specifically to FIG. 8, the semi-circular first ends 188,196 of the pair of inner side walls 88,92 from point A to point B has an arc length of approximately five percent of the total box boom lift arm length, point B to point C has a length of approximately twenty to thirty percent of the total box boom lift arm length and is angled at approximately two degrees from a horizontal plane, point C to point D has a length of approximately twenty-five percent of the total box boom lift arm length and is angled at approximately 10 degrees from a horizontal plane, point D to point E has a length of approximately forty-five to fifty-five percent of the total box boom lift arm length and is angled at approximately four degrees from a horizontal plane. The semi-circular second ends 192,200 of the pair of inner side walls 88,92 from point E to point F has an arc length of approximately five percent of the total box boom lift arm length, point F to point G has a length of approximately forty to sixty percent of the total box boom lift arm length and is angled at approximately five degrees from a horizontal plane, point G to point A has a length of approximately forty to fifty percent of the total box boom lift arm length and is angled at approximately seven degrees from a horizontal plane. Point C corresponds to the bend location and angle of the first plate member 124 of the bottom wall 120. Point G corresponds to the bend location and angle of the top wall 96.

A frame pin boss 220,224, made from tube steel, is disposed within each of the contoured frame boss mounting surfaces 204,208, respectively, and is fixedly connected to the legs 180,184 through a plurality of welds circumferentially extending substantially between the respective inner side wall 88,92 and outer side wall 148,152 and top and bottom walls 96,120. A lower coupler pin boss 228, made from tube steel, is disposed within the contoured coupler boss mounting surface 216 and is fixedly connected at the coupler end portion 144 through a plurality of welds circumferentially extending between the inner side walls 88,92 and top and bottom walls 96,120.

Each of the legs 180,184 of the bifurcated end portion 176 of the box boom lift arm assembly 84 extend into the respective exterior space 54,58 to straddle the central tower portion 38. The legs 180,184 of the bifurcated end portion 176 are pivotally connected to the non-engine end frame 26 through a pair of pin joints 232,236. Each of the pair of pin joints 232,236 includes a pin 240,244 which extends through a respective one of the pair of outer side wall portions 30,34 of the non-engine end frame 26, one of the pair of frame pin bosses 220,224 and one of the pair of inner side wall portions 42,46 of the non-engine end frame 26. The pair of pins 232,236 terminate adjacent one another within the interior space 50 in the central tower portion 38 and are connected to the non-engine end frame 26 in a well known manner.

Spaced rack and dump plates 250,254 are welded to a top surface 258 of the top wall 96 The rack plate 250 has a pair of spaced outward projections 262,266 and the dump plate 254 has a single outward projection 270 which act as stop pads. The outward projection 270 of the dump plate 254 has a length which extends substantially across the dump plate 254 approximately equal to the distance of the outward projections 262,266. Each of the outward projections 262, 266,270 have a contact surface 275 elevated above the top surface 258 of the top wall 96. The outward projections 262,266,270 of the rack and dump plates 250,254 are located at separate predetermined locations, respectively, on the top surface 258. The rack and dump plates 250,254 are positioned in relation to a specified portion of a minimum and maximum lift operation range 276,277, respectively, corresponding to a predetermined angle of the bucket 18 which can be seen more clearly in FIGS. 9-10. It should be noted that the rack and dump plates 250,254 may be a single plate located in a distinct position along the top surface 258 of the top wall 96. It should also be noted that the outward projections 262,266,270 of the rack and dump plates 250, 254, respectively, may include single or double stop pads or any combination thereof without diverting from the scope of the invention. A lift pin boss plate 278 is welded substantially at the central portion 132 of the bottom wall 120 and extends along a portion of the length of the bottom wall 120, approximately seventeen to twenty percent of the total box boom lift arm length. The lift pin boss plate 278 includes a pair of outwardly extending walls 282,286 which define a bracket for a pin joint 290. A lift cylinder 294 is pivotally connected at a first end 296 to the box boom lift arm assembly 84 at the pin joint 290 between the outwardly extending walls 282,286 through a pin 298 in a well known manner. A second end 302 of the lift cylinder 294 is pivotally connected to the non-engine end frame 26 within the interior space 50 of the central tower portion 38 between the inner side wall portions 42,46 through a pin joint 310. The pin joint 310 is positioned below the pin joints 232,236 and pivotally connects the box boom lift arm assembly 84 to the non-engine end frame 26 to provide an optimally flat lift response from the lift cylinder 294 during operation through the minimum and maximum lift range 276,277. The pin joint 310 includes a pin (not shown) which extends through the inner side wall portions 42,46 through the second end 302 of the lift cylinder 294 and is connected to the inner side wall portions 42,46 in a well known manner.

Figure 4:
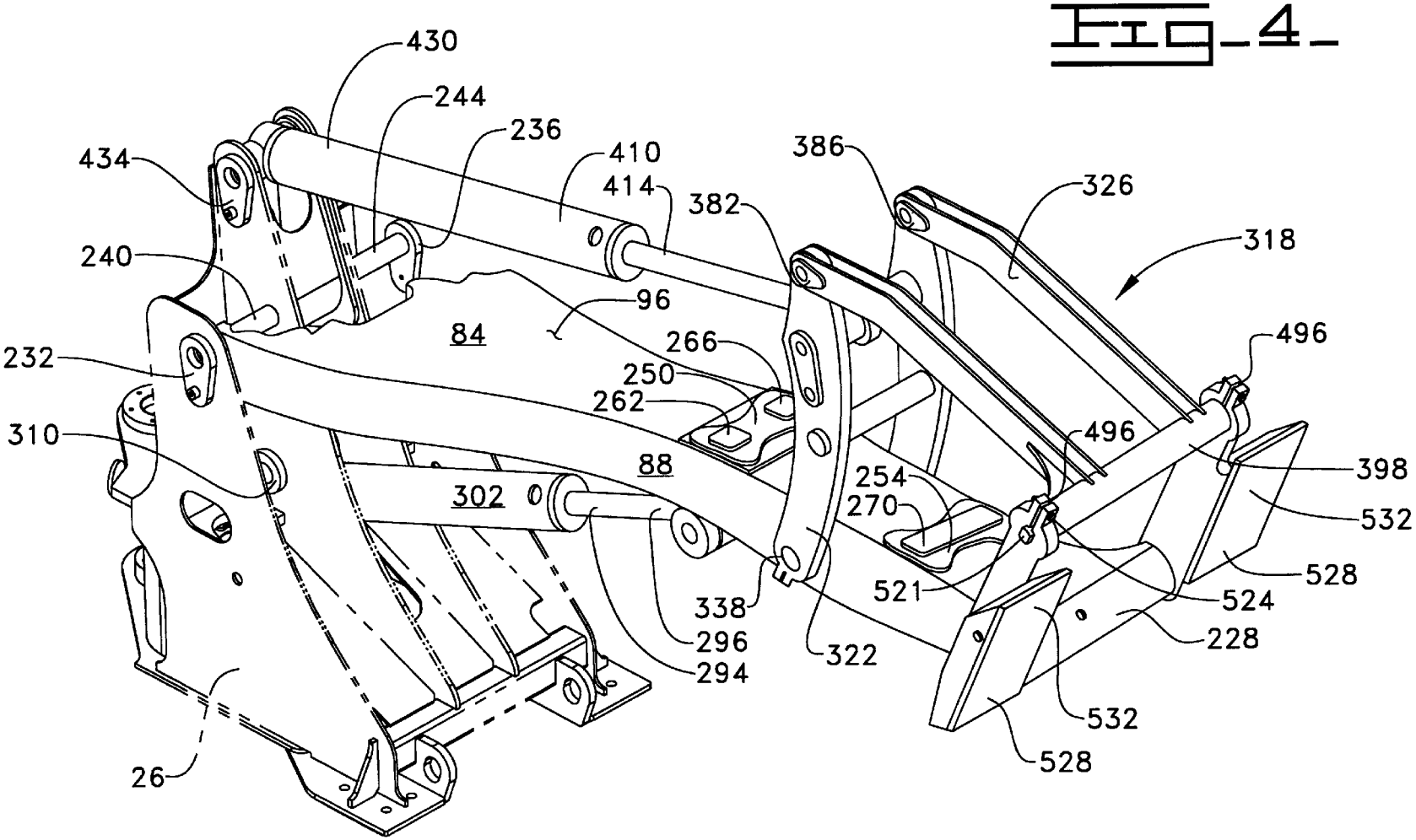
FIG. 4 is an isometric view of the non-engine end frame of FIG. 3 with the present invention mounted thereto.
Figure 5:
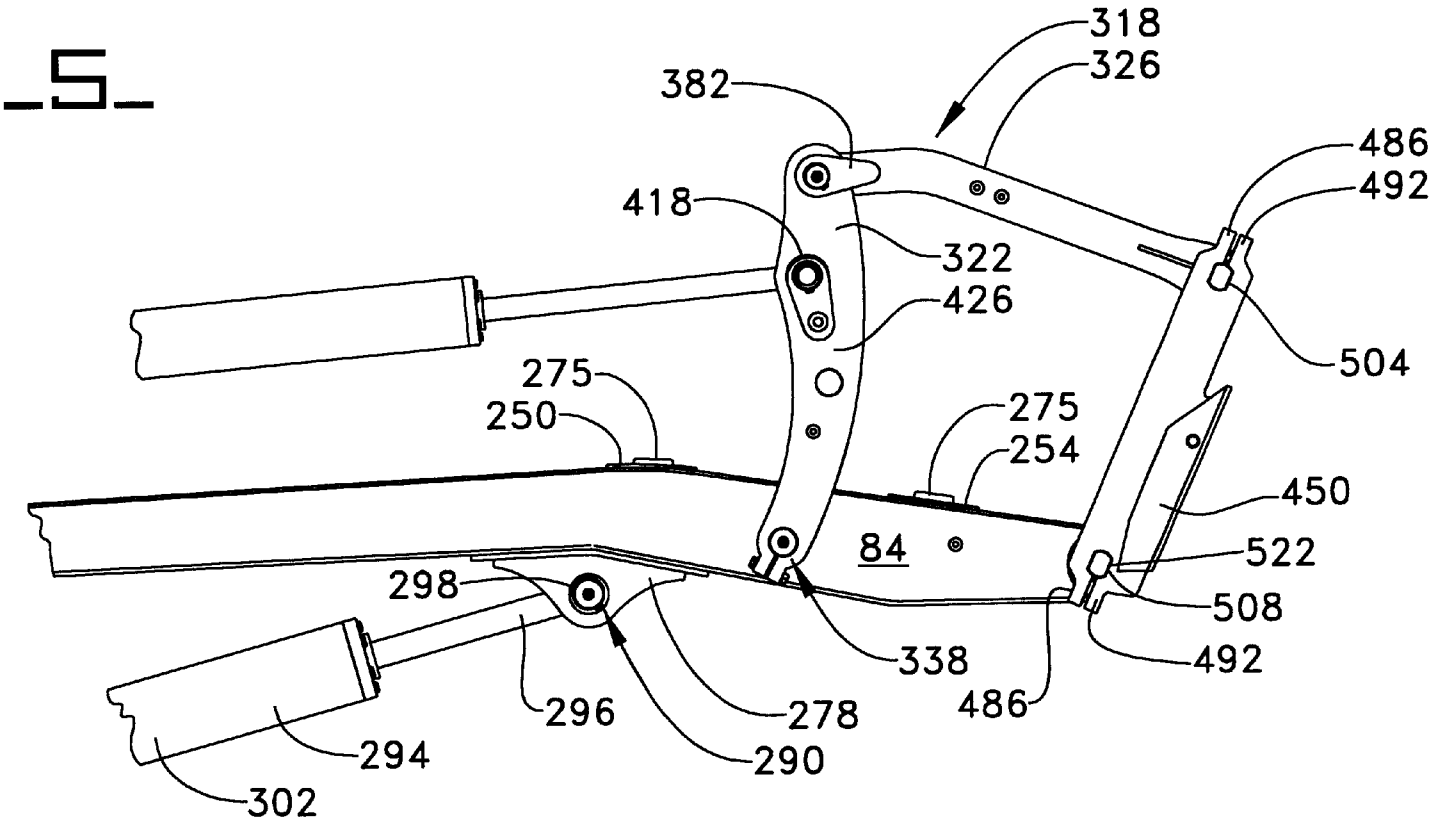
FIG. 5 is a side view of the non-engine end frame of FIG. 3 with the present invention mounted thereto.
Figure 6:
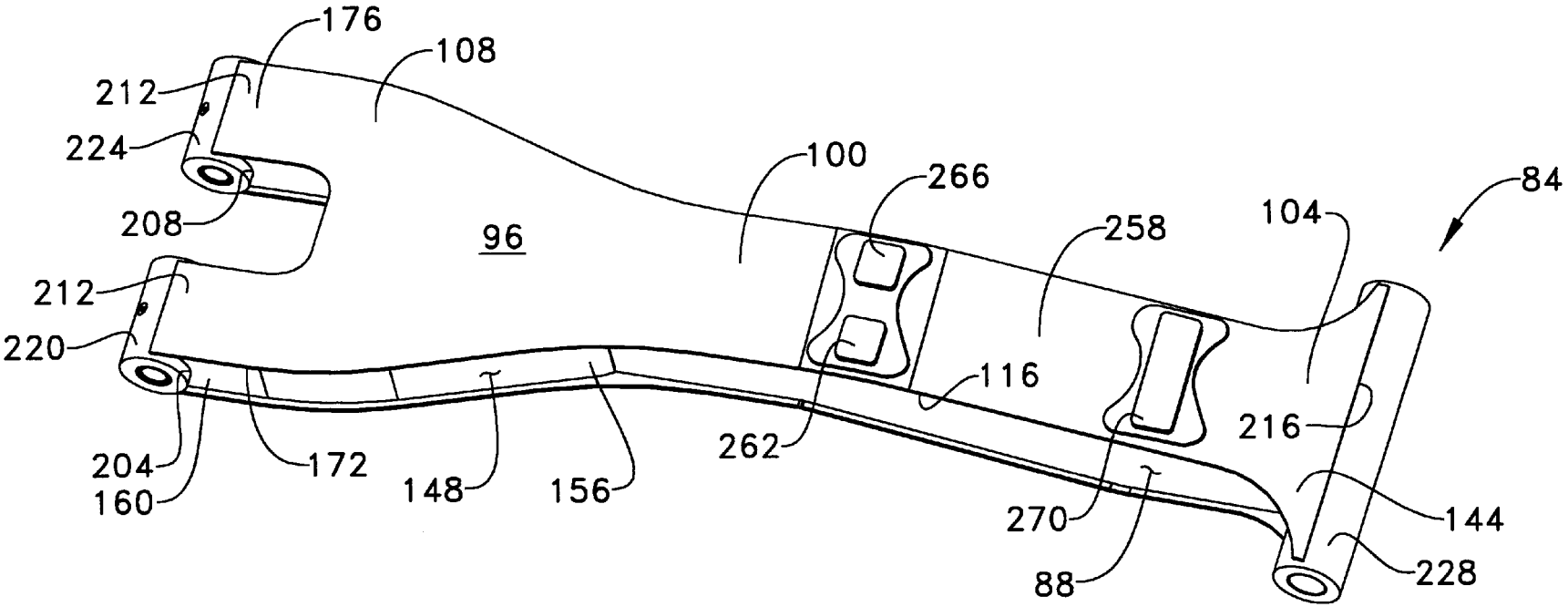
FIG. 6–8 are various views of a box boom lift arm assembly of the present invention.
Figure 7:
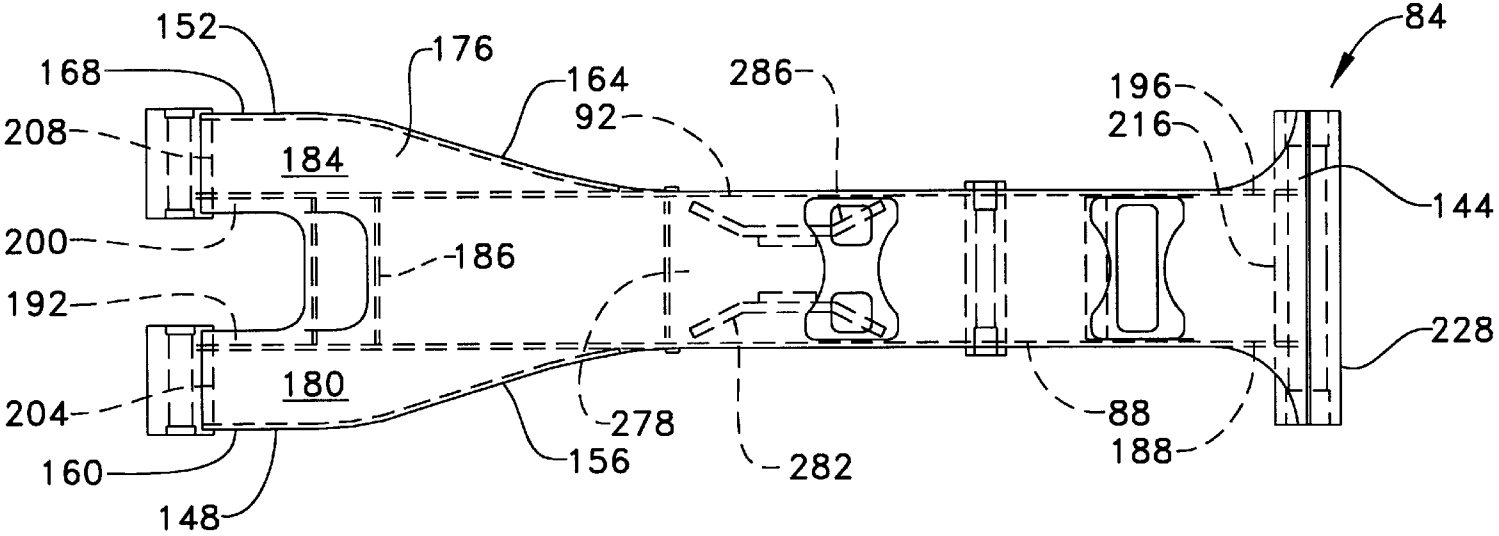
Figure 11:
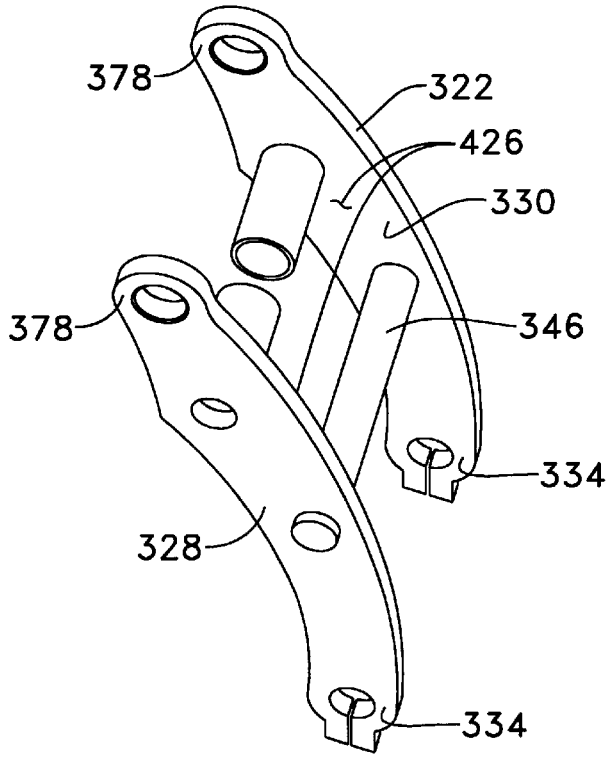
FIG. 11 is an isometric view of a tilt lever of the present invention.
Figure 12:
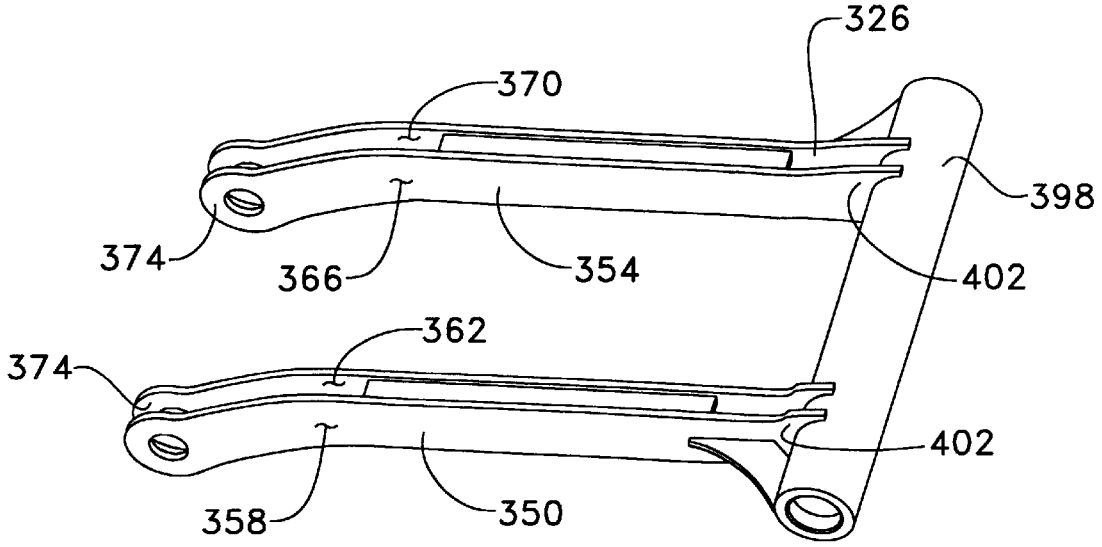
FIG. 12 is an isometric view of a tilt link of the present invention.

A tilt linkage means 318 is pivotally connected to the box boom lift arm assembly 84 as can be seen more clearly in FIGS. 4-5. The tilt linkage means 318 includes a tilt lever 322 and a tilt link 326 shown in detail in FIGS. 11-12. The tilt lever 322 has a pair of curved spaced side walls 328,330. A portion of the spaced side walls 328,330 straddle the top wall 96 of the box boom lift arm assembly 84. Each one of the pair of spaced side walls 328,330 of the tilt lever 322 is pivotally connected at a first end portion 334 to one of the pair of inner side walls 88,92 of the box boom lift arm assembly 84 at a pin joint 338. The pin joint 338 includes a pin (not shown) extending through the spaced side walls 328,330 and inner side walls 88,92 and is connected to the box boom lift arm assembly 84 through a boss (not shown) in a well known manner. The tilt lever 322 has a solid bar 346 fixedly connected thereto extending between the spaced side walls 328,330. The bar 346 is located at a position along the length of the spaced side walls 328,330 for contacting the outward projections 262,266,270 of the rack and dump plates 250,254 during the specified portion of the respective minimum and maximum lift 276,277. The tilt link 326 has a pair of spaced side rails 350,354 and each side rail 350,354 has a pair of spaced legs 358,362,366,370, respectively, which are angled for clearance at a specified location along the length thereof. One of the pair of spaced legs 358,362, 366,370 straddles one of the pair of spaced side walls 328,330 of the tilt lever 322 and is pivotally connected at a first end portion 374 to a second end portion 378 of the tilt lever 322 through a pair of separate pin joints 382,386. The pair of pin joints 382,386 include a pair of pins (not shown) which extend through the spaced legs 358,362,366,370 and spaced side walls 328,330 in a well known manner to define a spatial, unobstructed relationship between the pair of pin joints 382,386. An upper coupler pin boss 398 is welded to the spaced side rails 350,354 at a second end portion 402 of the tilt link 326 and extends therebetween at a length substantially equal to the length of the lower coupler pin boss 228 and greater than the spatial relationship between the pair of pin joints 382,386. The length of the upper coupler pin boss 398 is approximately 1.8 to 2.2 times the width of the central portion 100. A tilt cylinder 410 is pivotally connected at a first end 414 to the tilt lever 322 at a pin joint 418 located remotely from the pair of pin joints 382,386 at a predetermined distance. The pin joint 418 includes a pin (not shown) which extends between spaced side walls 328,330 of the tilt lever 322 through the first end 414 of the tilt cylinder 410 in a well known manner. The pin joint 418 is positioned between the pair of pin joints 382,386 and pin joint 338 above the tilt lever bar 346 and substantially above a central portion 426 of the tilt lever 322. A second end 430 of the tilt cylinder 410 is pivotally connected to the non-engine end frame 26 within the interior space 50 of the central tower portion 38 between the inner side wall portions 42,46 through a pin joint 434. The pin joint 434 is positioned approximately 0.1 to 0.2 times the length of the box boom lift arm 84 above the pin joints 232,236 which pivotally connect the box boom lift arm assembly 84 to the non-engine end frame 26 to enhance self-leveling characteristics of the tilt linkage means 318. The pin joint 434 may be positioned substantially co-linear with the pin joints 232,236 or therebehind. The pin joint 434 includes a pin (not shown) which extends through the inner side wall portions 42,46 through the second end 430 of the tilt cylinder 410 and is connected to the inner side wall portions 42,46 in a well known manner.

It should be noted that all dimensions and references thereof are given for perspective purposes only and may vary dependent on the machine or circumstances in which the invention is used.

Figure 13:
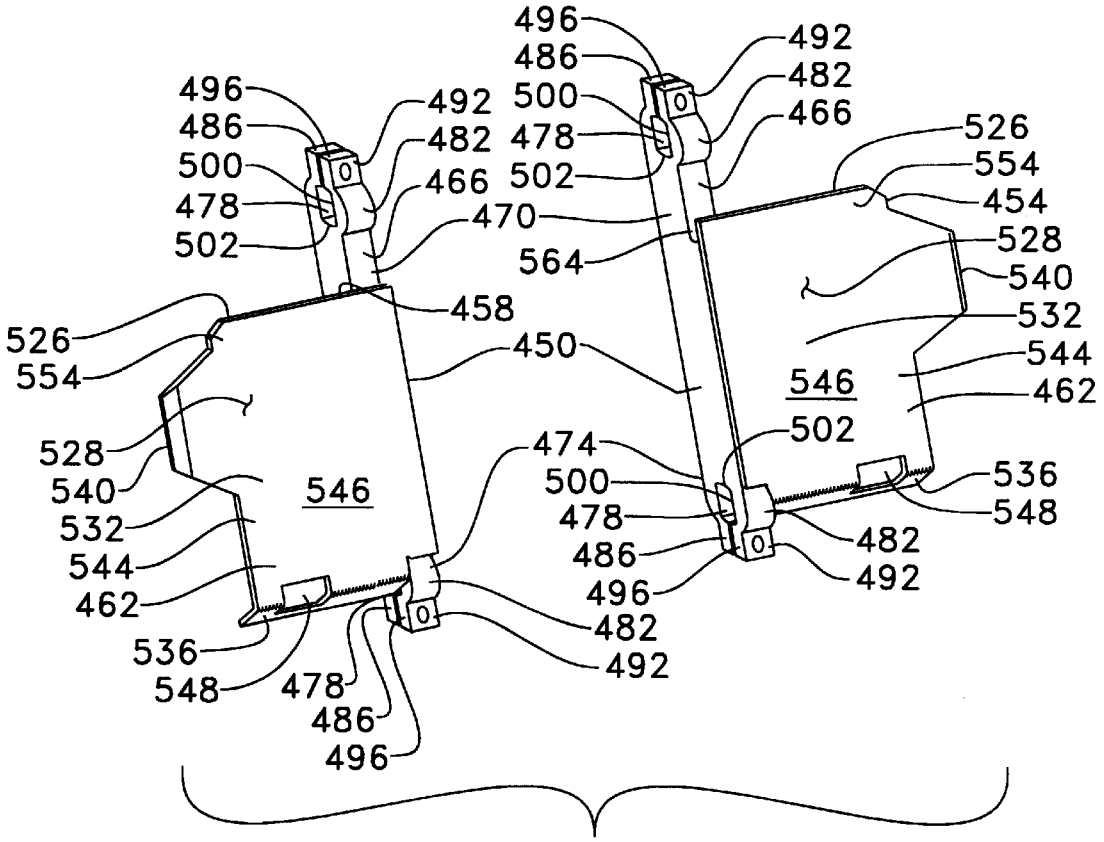
FIG. 13 is an isometric front view of a hydraulic tool coupler of the present invention.
Figure 15:
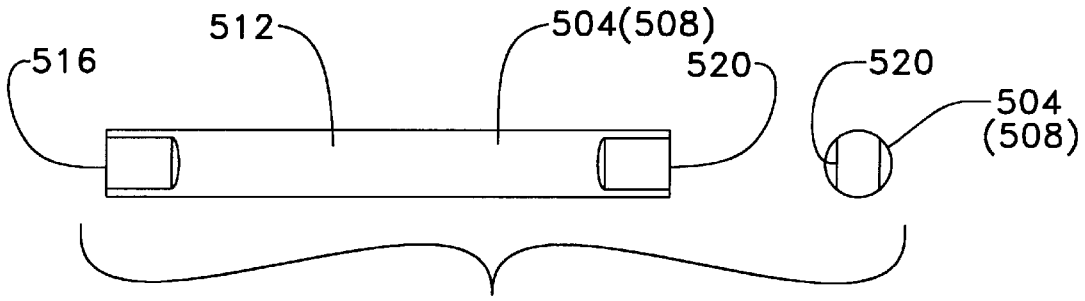
FIG. 15 is a top and side view of a pin used for connecting the hydraulic tool coupler of FIG. 14 to the box boom loader mechanism.
Figure 14:
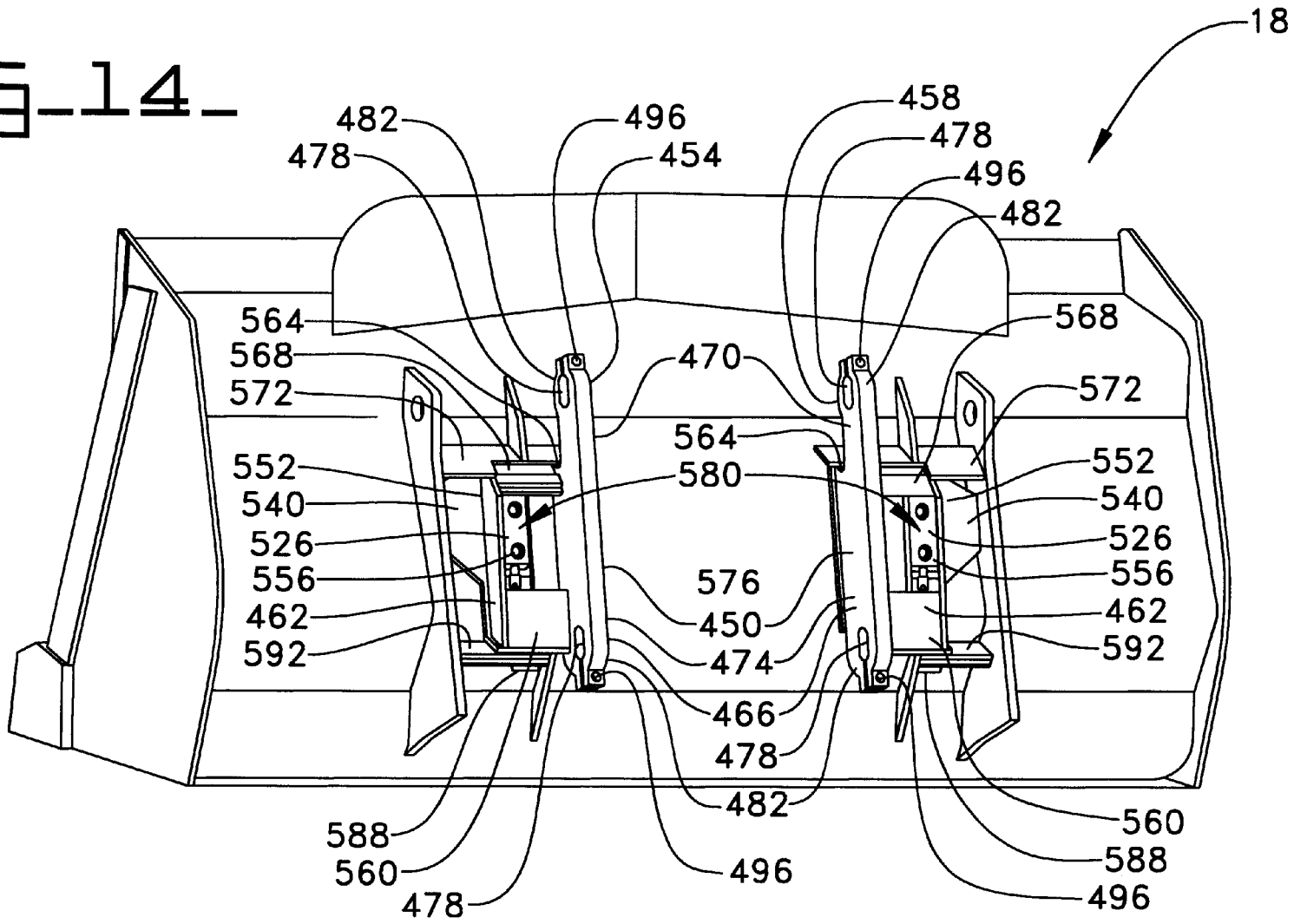
FIG. 14 is an isometric view of the hydraulic tool coupler of the present invention in connection with a work implement.

A hydraulic tool coupler 450, shown more clearly in FIGS. 13-14, has a pair of spaced coupler assemblies 454,458. The coupler assemblies 454,458 each have body portion 462 and a vertical plate portion 466 connected to the body portion 462 in any suitable manner, such as welding, casting or may be made integral therewith. The coupler assemblies 454,458 are located at opposing ends of the upper and lower coupler pin bosses 398,228 to define a spatial relationship therebetween. First and second end portions 470,474 of each of the vertical plates 466 include first and second pin mounting openings 478,479 with a substantially rectangular shape and a clamp portion 482 extending from the opening 478 and terminating in a pair of spaced flanges 486,492 with an opening 496 therethrough. The second pin mounting opening 479 is larger than the first pin mounting opening 478. The substantially rectangular shape consists of a pair of planar side walls 500 joined by a pair of arcuate end walls 502. A relief (not shown) is formed at the intersection between the side and end walls 500,502. A pair of pins 504,508, one of which is shown in FIG. 15, each have a cylindrical central portion 512 and substantially rectangular end portions 516,520 corresponding to the rectangularly shaped openings 478,479 in each of the vertical plates 466. The pair of pins 504,508, shown in FIG. 5, extend through the respective upper and lower coupler pin bosses 398,228 and through the pin mounting openings 478,479 of the vertical plates 466 of each of the pair of coupler assemblies 454,458. The cylindrical central portion 512 of the pair of pins 504,508 is disposed within the respective upper and lower coupler pin bosses 398,228 and the rectangular shaped end portions 516,520 are disposed within the rectangular shaped openings 478,479 in the vertical plates 466 to define a respective pair of pin joints 521,522. It should be understood that the pair of pins 504,508 are identical except that one of the pair of pins 508 is larger than the other one of the pair of pins 504 for proper fit within the larger pin mounting opening 479. It should also be understood that the pair of pins 504,508 and each of the pin mounting openings 478,479 may be substantially equal in size without exceeding the scope of the invention. A bolt assembly 524 extends through each of the coaxially aligned openings 478 in the vertical plates 466 and is tightened to clamp the pair of coupler assemblies 454,458 to the pair of pins 504,508 for connection with the tilt link 326 and the box boom lift arm assembly 84 of the box boom loader mechanism 10. Each body portion 462 includes a housing 526 and an engagement plate 528. The engagement plate 528 includes a front wall portion 532 which extends integrally into a lower wall portion 536 formed substantially thirty degrees from the front wall portion 532. A tool alignment projection 540 extends from an outermost edge portion 544 of the engagement plate 528 and is integral with the front wall portion 532 to define a planar surface 546. The lower wall portion 536 includes a substantially rectangular aperture 548. Each of the housings 526 is connected to a rear wall portion 552 of the engagement plate 528 in any suitable manner, such as welding. Each of the housings 526 include an upper edge portion 552, a central chamber portion 556 and a lower edge portion 560 seated against the lower wall portion 536 of the engagement plate 528. Each of the upper edge portions 552 of the housings 526 is operatively associated with a lip 564 of each of the vertical plates 466 to define a tool mounting edge 568. The tool mounting edge 568 is adapted to be received by a mounting cavity or ledge 572 formed transversely along an upper rear edge 576 of the of the implement 18. A hydraulic pin engagement system 580 is disposed within each of the central chamber portions 556 of the housings 526. Each hydraulic pin engagement system 580 includes a hydraulic cylinder (not shown) of any suitable type and is mounted vertically by a nut and bolt assembly (not shown). Each hydraulic cylinder (not shown) is conventionally connected to a wedge shaped engagement pin 588 which is substantially co-axially aligned with the rectangular aperture 548 in the lower wall portion 536 of the engagement plate 528. The lower wall portion 536 is seated against a seating ledge 592 of the implement 18. The seating ledge 592 has a rectangular aperture (not shown) which is substantially co-axially aligned with the rectangular aperture 548 in the lower wall portion 536.

Industrial Applicability

The operation of a construction machine 14, such as a wheel loader, normally includes the excavation of material from the ground or pile and the dumping of the material in a nearby truck or movement to a remote site. The bucket 18 is loaded primarily under the motive force of the wheel loader 14 as it is forced into the pile of material. The bucket 18 is simultaneously lifted through extension of the lift cylinder 294 and rotated toward the wheel loader 14, or racked back, through the lift operation range 276,277 by the retraction of the tilt cylinder 410. In the event that the material is to be dumped into the truck, it is crucial that the bucket angle is controlled at a portion of the minimum and maximum lift operation range 276,277. The bucket angle at a portion of the minimum lift operation range 276 must be sufficient to prevent the material from spilling from the bucket 18 and the bucket angle at a portion of the maximum lift operation range 277 must be sufficient to dump substantially all the material into the truck. This is accomplished through the mechanical rack and dump stops 250,254 on the top surface 258 of the top wall 96 of the box boom lift arm assembly 84. The tilt lever 322 was designed so that sufficient material was provided for incorporation of the bar 346. The bar 346 and the outward projections 262,266 on the rack stop 250 are positioned for contact when the bucket reaches a preselected angle with respect to the ground at a portion of the minimum lift operation range 276. The bar 346 on the tilt lever 322 and the outward projection 270 on the dump stop 254 are positioned for contact when the bucket reaches a preselected, negative angle with respect to the ground at a portion of the maximum lift operation range 277. The position of the rack and dump stops 250,254 on the top wall 96 provides a larger area for the dispersion of the impact loads as compared to cantilevered stops typically used in wheel loader linkages. It should be noted that should only one plate be used for the rack and dump stops, other structure may be used in place of or in operation with the bar 346 for contact with the plate to provide similar functionability.

It is well known that the loads and forces on the box boom loader mechanism 10 through the box boom lift arm assembly 84 and the linkage means 318 can be extremely severe dependent on various factors of operation, making it imperative to increase strength and loading capabilities of all the components thereof. The present invention has several factors which increase the strength and load capabilities of the box boom loader mechanism 10. For example, the box boom lift arm assembly 84 provides additional strength for lateral and torsional loads. Additionally, the unique connection of the box boom lift arm assembly 84 to the non-engine end frame 26 through the bifurcated end portion 176 enhances load distribution. This is accomplished due to the distribution of loading across the pin joints 232,236 and into the non-engine end frame 26 due to the pins 240,244 which extend through the central tower portion 100. The rectangular cross section is maintained throughout the entire box boom lift arm assembly 84 and only varies in height and width. The sectional property of the box boom lift arm assembly 84 provides for a lower weight to strength performance ratio. Furthermore, the manufacture of the box boom lift arm assembly 84 from a completely welded fabrication of plate and tube steel substantially eliminates transverse weld joints which improves its fatigue characteristics. The increased width of the bifurcated end portion 176 at the connection with the non-engine end frame 26 is designed to spread box boom lift arm assembly 84 loads at the non-engine end frame 26 which also increase torsional and lateral stiffness of the box boom loader mechanism 10. The increased width of the coupler end portion 144 also serves to improve the mechanical strength, durability and reliability of the box boom lift arm assembly 84 near the pin joints 521,522. The pair of pins 504,508 act as structural members of the hydraulic tool coupler 450 to provide torsional load carrying capability. The lift cylinder 294 is connected to the bottom wall of the box boom lift arm assembly 84 through the lift pin boss plate 278 for a larger footprint and better distribution of lift cylinder forces.

During tool coupling and loading operations, it is very beneficial for the operator of the wheel loader 14 to be able to see the corners of the bucket 18 and the coupling interface. The pivotal connection between the tilt cylinder 410 and the tilt lever 322 is placed in consideration of not only design constraints for clearance imposed by the box boom lift arm assembly, product requirements of mechanical self-leveling and optimal break-out performance but also for increased visibility. This occurs, in part, due to the tilt cylinder 410 being separated from the pair of pin joints 382,386 between the tilt lever 322 and tilt link 326. Additionally, the lengths of the tilt lever 322 and tilt link 326 are such that the length ratios between all the pivot pins of the six-bar linkage provide optimal linkage performance for load capacity, self-leveling of the bucket 18 and increased visibility. The curved and angled shape of the tilt lever 322 and tilt link 326, respectively, are such for consideration of design constraints imposed by the box boom lift arm assembly 84. Additionally, the connection of the tilt lever 322 and tilt link 326 enhance the linkage performance while increasing visibility. The use of a separated pair of coupler assemblies 454,458 facilitates ease of assembly to the box boom lift arm assembly 84 and tilt link 326. The use of the pair of pins 504,508 with the separated pair of coupler assemblies 454,458 precludes the necessity for a structural torque tube across the width of the hydraulic tool coupler 450 which further enhances the visibility of the box boom loader mechanism 10 at the coupler end portion 144, Other aspects, objects and advantages of this invention can be obtained from a study of the drawings, disclosure and the appended claims.

We claim:

1. A box boom loader mechanism for use on a construction machine having a frame with a pair of outer side wall portions, a central portion with a pair of inner side wall portions disposed between the outer side wall portions and spaced a predetermined distance therefrom, comprising:

a box boom lift arm assembly having a pair of inner side walls extending a predetermined length, top and bottom walls extending a predetermined length substantially equal to the predetermined length of the pair of inner side walls and fixedly connected therewith to define a first end portion and a pair of outer side walls connected at a predetermined location along the predetermined length of the pair of inner side walls and extending outwardly therefrom a predetermined length with each outer side wall being fixedly connected to the top and bottom walls to define a bifurcated second end portion opposite the first end portion, the bifurcated second end portion sized to straddle the central portion of the frame and terminating at a frame pin joint pivotally connectable with the frame;

a tilt linkage means pivotally connected to the box boom lift arm assembly;

a lower pin boss fixedly connected to the box boom lift arm assembly at the first end portion and an upper pin boss fixedly connected to the tilt linkage means;

a first hydraulic cylinder pivotally connectable to the frame at a first end and pivotally connected to the tilt linkage means at a second end; and a second hydraulic cylinder pivotally connectable to the frame at a first end and pivotally connected at a second end to the box boom lift arm assembly at a first pin joint adjacent the bottom wall.

2. The box boom loader mechanism as in claim 1, wherein the frame pin joint includes a pair of frame pin bosses with each frame pin boss fixedly connected to a leg of the bifurcated second end portion and a pair of pins, each of the pair of pins extendable through one of the pair of outer side wall portions of the frame, one of the pair of the frame pin bosses and one of the pair of inner side wall portions of the frame and terminable within the central portion of the frame.

3. The box boom loader mechanism of claim 1, wherein the pair of inner side walls and top wall of the box boom lift arm assembly are fixedly connected through a continuous non-transverse weld extending substantially along the entire predetermined length of the pair of inner side walls, the pair of inner side walls and the bottom wall are fixedly connected through a continuous substantially non-transverse weld extending substantially along the entire predetermined length of the pair of inner side walls and the pair of outer side walls and top and bottom walls are fixedly connected through a continuous non-transverse weld extending substantially along the predetermined length of the outer side walls.

4. The box boom loader mechanism as in claim 1, wherein the tilt linkage means includes a tilt lever pivotally connected to the box boom lift arm assembly at a second pin joint and a tilt link pivotally connected to the tilt lever at a first end with the upper coupler pin boss being fixedly connected to the tilt link at an end opposite the first end.

5. The box boom loader mechanism of claim 4, wherein the tilt lever has a pair of spaced side walls with each one of the pair of spaced side walls being pivotally connected to one of the pair of inner side walls of the box boom lift arm assembly at the second pin joint, the tilt link has a pair of spaced side rails with each one of the pair of side rails being pivotally connected at the first end of the tilt link to one of the pair of side walls of the tilt lever at respective spaced third and fourth pin joints and the upper coupler pin boss extends between the pair of side rails of the tilt link.

6. The box boom loader mechanism of claim 5, wherein the first end of the first and second hydraulic cylinders are connectable at the central portion of the frame, the first and second ends of the first hydraulic cylinder are positioned above the top wall of the box boom lift arm assembly, the second end of the first hydraulic cylinder is positioned below the third and fourth pin joints and therebetween at a fifth pin joint above a central portion of the tilt lever and the first end of the second hydraulic cylinder is positioned below the bottom wall of the box boom lift arm assembly.

7. The box boom loader mechanism of claim 6, wherein the bifurcated second end portion and the first end portion of the box boom lift arm assembly each have a predetermined width greater than a predetermined width of a central portion of the box boom lift arm assembly.

8. The box boom loader mechanism of claim 7, wherein the first end portion diverges outwardly from the central portion on the top and bottom walls to establish the greater width.

9. The box boom loader mechanism of claim 8, including a tool coupler fixedly connected at sixth and seventh pin joints at the respective upper and lower pin bosses for allowing relative movement with the tilt link and the box boom lift arm assembly.

10. The box boom loader mechanism of claim 7, wherein the second end of the second hydraulic cylinder is pivotally connected to the box boom lift arm assembly through a plate assembly substantially located at the central portion of the bottom wall of the boom lift arm assembly, the plate assembly extending a predetermined length along the predetermined length of the bottom wall.

11. The box boom loader mechanism of claim 6, wherein rack and dump stops are positioned at a predetermined location on a top surface of the top wall of the box boom lift arm assembly, the rack and dump stops including an outward projection having a contact surface elevated above the top surface of the top wall.

12. The box boom loader mechanism of claim 11, wherein the tilt lever includes a bar connected to and extending between the pair of side walls at a predetermined position between the second end of the first hydraulic cylinder and the top wall of the box boom lift arm assembly and each of the pair of side rails of the tilt link is angled at a predetermined location and angle.

13. The box boom loader mechanism of claim 12, wherein the bar of the tilt lever contacts the rack stop when the box boom loader mechanism is in a portion of a minimum lift operation range and the bend angle of each of the pair of side rails is adjacent and in a non-contacting relationship with the fifth pin joint and the bar of the tilt lever contacts the dump stop when the box boom loader mechanism is in a portion of a maximum lift operation range.

* * * * *